United States Patent [19]

Ruppert et al.

[11] Patent Number: 4,658,837

[45] Date of Patent: Apr. 21, 1987

[54] APPARATUS FOR FILLING CIGARETTE TUBES

[75] Inventors: Heinrich W. Ruppert, Trossingen; Klaus Gätschmann, Bad Dürrheim, both of Fed. Rep. of Germany

[73] Assignee: EFKA-Werke Fritz Kiehn GmbH, Trossingen, Fed. Rep. of Germany

[21] Appl. No.: 608,543

[22] Filed: May 9, 1984

[30] Foreign Application Priority Data

May 19, 1983 [DE] Fed. Rep. of Germany ..... 3318239

[51] Int. Cl.[4] ..... A24C 5/42

[52] U.S. Cl. ..... 131/70; 131/280

[58] Field of Search ..... 131/280, 70, 71, 74

[56] References Cited

U.S. PATENT DOCUMENTS

| | | | |
|---|---|---|---|
| 2,714,383 | 8/1955 | Ming Gee | 131/70 |
| 3,124,141 | 3/1964 | Seitter | 131/70 |
| 3,693,650 | 9/1972 | Kastner | 131/70 |
| 4,215,705 | 8/1980 | Marcil | 131/70 |
| 4,249,546 | 2/1981 | Heil et al. | 131/70 |

*Primary Examiner*—Vincent Millin

*Assistant Examiner*—H. Macey

*Attorney, Agent, or Firm*—Browdy and Neimark

[57] ABSTRACT

In a manual apparatus for tamping cigarette tubes with tobacco, comprising a casing having a tobacco compressing chamber disposed in the longitudinal direction thereof, a cover-type press bar associated with this tobacco compressing chamber and located in a cover that covers the casing and being swingable about an axis, as well as an ejector slide, which is connected with a spoon 25 that carries a plug of tobacco, for introducing the pressed tobacco plug into a cigarette tube intermittently clampingly held against a short socket, a clamping element embodied such as to separate the clamping operation from the filling operation is provided. The clamping element (14) for a cigarette tube (4) mounted on the short socket (3) is independent of the cover (6) and is controlled by the ejector slide (7). It is spring loaded and disposed laterally beside the short socket (3). In particular, a control ledge (8) connected with the ejector slide (7) is provided, which cooperates with the clamping element (14), the latter being displaceable at right angles to the longitudinal axis of the short socket (3).

7 Claims, 3 Drawing Figures

APPARATUS FOR FILLING CIGARETTE TUBES

FIELD OF THE INVENTION

The present invention relates to a manual apparatus for filling or tamping prepared cigarette tubes with tobacco. It comprises a casing, which has a tobacco compressing chamber disposed in the longitudinal direction of the casing; a cover-type-press bar associated with this chamber and located in a cover that covers the casing and is swingable about an axis and an ejector slide, which is connected to a spoon carrying a plug of cut smoking tobacco, for introducing the pressed tobacco plug into a cigarette tube which is held intermittently clampingly on a short socket.

BACKGROUND OF THE INVENTION

Many forms of embodiment of the above type of filling apparatus are known. Attempts have herefore been made to trigger or actuate as many functions of such an apparatus as possible, using only a single element. Difficulties arose, however, particularly in cases where the clamping device was actuated either directly or indirectly by the cover, because of the attendant superimposition of the various tolerances and other imprecise factors upon one another.

SUMMARY OF THE INVENTION

It is accordingly the object of the present invention to separate the clamping operation from the filling or tamping operation, and to improve the clamping operation without making the apparatus less convenient to use.

This object is substantially attained in accordance with the invention by providing a clamping element for a cigarette tube placed upon the short socket which is independent of the cover and is controlled by the ejector slide. This clamping element is spring-loaded and is disposed laterally of, and adjacent to, the short socket.

As a result of the invention, it is possible to use a cover of any arbitrary embodiment for closing the tobacco compressing chamber, yet the cigarette tube can be clamped firmly not by means of the closure of the cover, but rather by means of a second movement that necessarily takes place in any event in the filing process.

According to a preferred exemplary embodiment of the invention, a control ledge connected with the ejector slide is provided for cooperating with the clamping element which is displaceable at right angles to the longitudinal axis of the short socket.

It is particularly suitable if the clamping element is guided in a holder block provided an a holder part that is connected with the front casing wall.

A compression element for the clamping element is advantageously disposed in the holder block. This compression element serves to lift the clamping element up from the short socket, so that the clamping element is not pressed against the short socket, or in other words against the cigarette tube mounted on the socket, until after the compressing force of the compression element has been overcome by the ejector slide. It is particularly suitable if a compression spring is used as an elastic compression element.

In an advantageous embodiment of the invention, the clamping element is embodied such that it is concave on its end oriented toward the short socket.

In order to avoid damaging the cigarette tube after the filling operation has been completed, it is advantageous in a further embodiment of the invention for the control ledge to be embodied in such a manner, for instance being beveled, in its terminal-position areas that no displacement of the clamping element is possible when it is in one of these terminal positions, or that the clamping element is retracted from the cigarette tube by the action of the compression spring.

The invention is equally applicable to cigarette filling apparatuses in which the tobacco plug formed in the tobacco compressing chamber is pushed into a cigarette tube with the aid of the spoon and to cigarette filling apparatuses in which the cigarette tube is pulled over the tobacco plug that has been formed.

Further details, characteristics and advantages of the invention will now be described, referring to the illustration of an exemplary embodiment shown in the drawing.

DESCRIPTION OF THE PREFERRED EMBODIMENT

Figure 1:
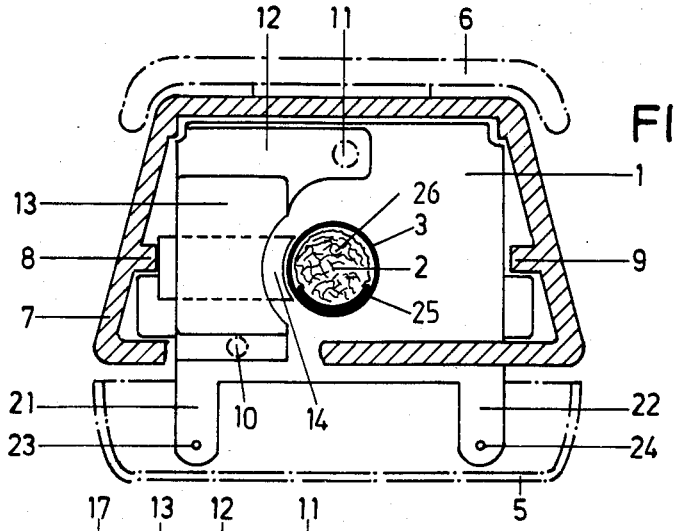
FIG. 1 is an end view of a cigarette filling apparatus having the clamping device according to the invention.

A filling or tamping apparatus of an arbitrary type having an arbitrarily embodied tobacco compressing chamber, tobacco compressing bar and cover (not shown) has a front wall 1, in which an outlet opening 2 for the tobacco plug 26 (carried by a spoon 25) is located, and on which a short socket 3 having a cigarette tube 4 mountable thereupon is disposed, as shown in FIG. 1.

Figure 2:
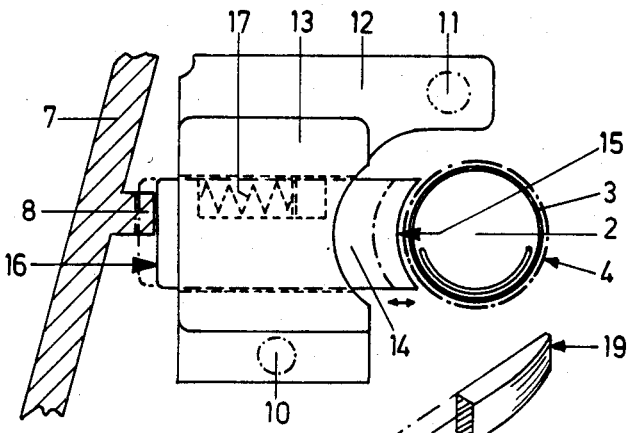
FIG. 2 shows the clamping device of FIG. 1 in a fragmentary sectional view.
Figure 3:
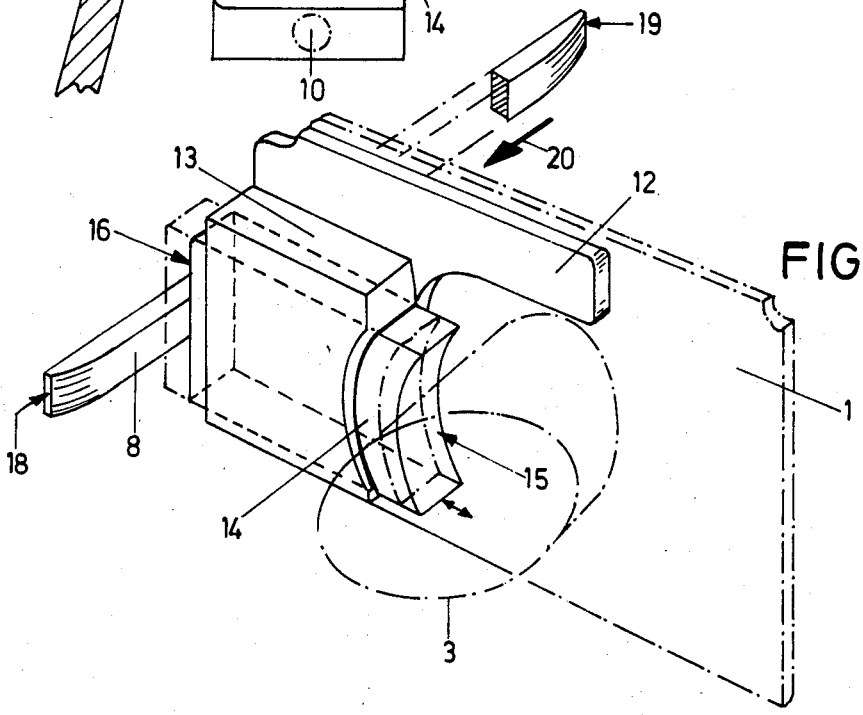
FIG. 3 is a perspective view of the clamping device with the actuating ejector slide.

The apparatus is closed off by a bottom 5 and a cover part 6. An ejector slide 7 to which spoon 25 is connected for movement therewith, is guided on parallel, inwardly pointing lateral ledged 8, 9 on the pivotable filler part which is otherwise, however, disposed integral with the system. On the front wall 1, by means of rivets 10, 11 or the like, a holder part 12 with a holder block 13 are disposed for receiving and guiding a clamping element 14. The end 15 of the clamping element 14 oriented toward the short socket 3 is concave in embodiment. The other end 16 in a state of sliding contact with the ledge 8 of the ejector slide 7. The clamping element 14 is subject to the action of an elastic structural part, in particular an elastic compression element such as a compression spring 17, which in the state of rest keeps the clamping element 14 pressed away from the socket 3. The clamping element 14, which is preferably guided horizontally, is thus in a state of rest as well, whenever the compression element or spring 17 is relaxed as soon as the holder block 13 is located in one of the end zones 18 or 19 of the ledge 8 before or after actuation of the ejector slide 7. In this case, the clamping element 14 assumes the dot-dash position shown in FIG. 2 or FIG. 3. The distance between the concave end 15 of the clamping element 14 and the outer wall of the socket 3 which is required for mounting the cigarette tube 4 onto the socket 3 or removing it thereform is thus assured at the same time.

If the ejector slide 7, with the prepared length of tobacco plug, is actuated in the direction of the arrow 20, then the clamping element 14 is pressed by the increasing thickness of the ledge 8, counter to the pressure of the elastic compression element or spring 17, in the direction toward the socket 3, and for the duration of the filling operation it clamps the cigarette tube 4 against the outer wall of the socket 3, thereby assuring a properly performed filling of the cigarette tube 4. Reference numerals 21 and 22 indicate tongues offstanding from the casing; when the apparatus is closed, these tongues 21, 22 lock resiliently into place in a bottom part 5 by means of the buttons 23, 24 molded on the tongues.

The invention is not limited to the exemplary embodiment shown and described herein. It also encompasses all modifications and further developments within the competence of one skilled in the art, as well as combinations among all or some of the characteristics and provisions shown and described. It is applicable in particular to cigarette tube filling apparatus of the general type described at the outset above, regardless of the structure of the filling apparatus per se.

What is claimed is:

1. In a manual apparatus for tamping tobacco into cigarette tubes of the type including a casing having a tobacco compressing chamber disposed in a longitudinal direction thereof, a press bar associated with said tobacco compressing chamber for effecting compression of said tobacco in said chamber and located in a cover covering said chamber and being swingable about an axis, and an ejector slide, connected with a spoon carrying the tobacco, for ejecting the compressed tobacco from said chamber into a cigarette tube supportable on a short socket aligned with said chamber, the improvement comprising:

a spring-loaded clamping element for selectively clamping said cigarette tube on the short socket, said clamping element being independent of said cover, and having a first end and a second opposite end, said second end being disposed laterally beside, and normally spaced from, said short socket, said ejecting slide being supported by said casing for sliding motion relative thereto in said longitudinal direction and including camming means coacting with said clamping element first end, for selectively moving said clamping element second end into clamping engagement with said tube as said ejecting slide is manually slid relative to said casing to eject said compressed tobacco from said chamber.

2. The improvement as defined by claim 1, wherein said camming means extends in said longitudinal direction and includes a control ledge, said control ledge having a first thickness at opposing ends thereof and a second greater thickness between said opposing ends, said first thickness coacting with said clamping element first end to maintain said clamping element second end spaced from said short socket, and said second thickness coacting with said clamping element first end to press said clamping element second end into engagement with said short socket.

3. The improvement as defined by claim 2, wherein said control ledge includes beveled end portions, said end portions defining means for preventing displacement of said clamping element when said end portions of said control ledge cooperate with said clamping element.

4. The improvement as defined by claim 1, wherein said casing includes means, provided on a front wall of said casing, for guiding movements of said clamping element in directions normal to said longitudinal direction.

5. The improvement as defined by claim 4, and further including elastic compression means engaging said clamping element, said compression means being disposed in said guiding means and normally urging said clamping element away from said short socket.

6. The improvement as defined by claim 5 wherein said elastic compression means comprises a compression spring.

7. The improvement as defined by claim 1, wherein said clamping element second end is concave.

* * * * *